US011145980B2

(12) United States Patent
Segador Alvarez et al.

(10) Patent No.: US 11,145,980 B2
(45) Date of Patent: Oct. 12, 2021

(54) MULTIBAND ANTENNA

(71) Applicant: Huawei Technologies Co., Ltd., Shenzhen (CN)

(72) Inventors: Juan Segador Alvarez, Munich (DE); Tao Tang, Dongguan (CN); Bruno Biscontini, Munich (DE); Ignacio Gonzalez, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 16/781,659

(22) Filed: Feb. 4, 2020

(65) Prior Publication Data

US 2020/0176873 A1 Jun. 4, 2020

Related U.S. Application Data

(63) Continuation of application No. PCT/EP2017/069811, filed on Aug. 4, 2017.

(51) Int. Cl.
*H01Q 5/50* (2015.01)
*H01Q 1/52* (2006.01)
*H01Q 21/30* (2006.01)

(52) U.S. Cl.
CPC ..... *H01Q 5/50* (2015.01); *H01Q 1/523* (2013.01); *H01Q 21/30* (2013.01)

(58) Field of Classification Search
CPC ..... H01Q 5/50; H01Q 5/42; H01Q 21/30; H01Q 21/08; H01Q 1/523
See application file for complete search history.

(56) References Cited

U.S. PATENT DOCUMENTS 6,239,750 B1 * 5/2001 Snygg ..... H01Q 1/246 343/700 MS
6,333,720 B1 12/2001 Göttl et al.
(Continued)

FOREIGN PATENT DOCUMENTS

CN 101553955 A 10/2009
CN 201975518 U 9/2011
(Continued)

OTHER PUBLICATIONS

"APE4518R20v06 Antenna Specifications," pp. 1-3, Huawei Technologies Co. Ltd., Shenzhen, P.R. China (Sep. 24, 2014).
(Continued)

*Primary Examiner* — Lam T Mai
(74) *Attorney, Agent, or Firm* — Leydig, Voit & Mayer, Ltd.

(57) ABSTRACT

An antenna has a plurality of first radiating elements configured to radiate in a first frequency band and a plurality of second radiating elements configured to radiate in a second frequency band. The second frequency band at least partially overlaps the first frequency band. The first radiating elements are arranged along the longitudinal direction of the antenna in a first column, and the second radiating elements are arranged along the longitudinal direction of the antenna in a second column. The second column is separated from the first column along a lateral direction of the antenna. Further, feed points of each first radiating element are separated from feed points of each second radiating element along a bore sight direction of the antenna.

17 Claims, 10 Drawing Sheets

(56) References Cited

U.S. PATENT DOCUMENTS 6,452,549 B1* 9/2002 Lo ..... H01Q 9/28 343/700 MS
7,079,083 B2 7/2006 Göttl et al.
9,293,809 B2 3/2016 Teillet et al.
2003/0011529 A1 1/2003 Göttl
2007/0109202 A1* 5/2007 Vance ..... H01Q 1/36 343/702
2007/0159399 A1* 7/2007 Perunka ..... H01Q 1/243 343/700 MS
2007/0210969 A1* 9/2007 Vance ..... H01Q 9/0457 343/702
2008/0007469 A1* 1/2008 Hung ..... H01Q 9/42 343/702
2008/0048926 A1* 2/2008 Wu ..... H01Q 1/243 343/846
2010/0134359 A1 6/2010 Manholm et al.
2010/0164821 A1* 7/2010 Huang ..... H01Q 13/10 343/767
2010/0214181 A1* 8/2010 Ryou ..... H01Q 9/0421 343/702
2011/0037680 A1* 2/2011 Chiu ..... H01Q 9/0421 343/893
2012/0019415 A1* 1/2012 Tseng ..... H01Q 5/20 343/700 MS
2012/0162022 A1* 6/2012 Wei ..... H01Q 9/42 343/700 MS
2012/0162023 A1* 6/2012 Tai ..... H01Q 1/42 343/700 MS
2012/0280878 A1 11/2012 Timofeev
2012/0280880 A1 11/2012 Arvidsson et al.
2013/0162486 A1* 6/2013 Korva ..... H01Q 21/30 343/725
2014/0313094 A1* 10/2014 Berezin ..... H01Q 1/521 343/810
2015/0009078 A1 1/2015 Sun et al.
2016/0285169 A1* 9/2016 Shooshtari ..... H01Q 21/062
2016/0294062 A1* 10/2016 Lo Hine Tong ..... H01Q 21/30
2020/0212598 A1* 7/2020 Gonzalez ..... H01Q 25/001
2020/0212600 A1* 7/2020 Gonzalez ..... H04B 7/0413
2020/0235487 A1* 7/2020 Gonzalez ..... H01Q 5/42

FOREIGN PATENT DOCUMENTS

CN 102694275 A 9/2012
CN 102769174 A 11/2012
CN 202997053 U 6/2013
CN 103560338 A 2/2014
CN 103972660 A 8/2014
CN 104269649 A 1/2015
CN 204857971 U 12/2015
CN 106876894 A 6/2017
EP 3010087 A1 4/2016

OTHER PUBLICATIONS

CN/201780093075.0, Notice of Allowance, dated Jun. 23, 2021.
Zhang "Design of Multi Array and Broadb and Dual Polarization Antenna," Fiber Home Technologies Group, Total 2 pages (2017). With English Abstract.

* cited by examiner

MULTIBAND ANTENNA

CROSS-REFERENCE TO RELATED APPLICATIONS

This application is a continuation of International Application No. PCT/EP2017/069811, filed on Aug. 4, 2017, the disclosure of which is hereby incorporated by reference in its entirety.

TECHNICAL FIELD

The present invention relates to a multiband antenna.

BACKGROUND

With the deployment of LTE systems, network operators are adding new spectrum to the networks in order to increase the network capacity. Therefore, antenna vendors are requested to develop new antennas that have more ports and/or arrays and support new frequency bands, without increasing the size of conventional antennas.

Especially in order to exploit all capabilities of the LTE standard, new antennas support 4×4 Multiple Input Multiple Output (MIMO), which is particularly useful in higher frequency bands (HB), but is also desired in lower frequency bands (LB) so as to be ready for future deployments. Typical MIMO requirements in current LTE deployments are shown in the below table, where the first column indicates the operating frequency band, and the second column indicates the associated MIMO requirement.

| Operating Band | MIMO Requirement |
|---|---|
| 700 | 2 × 2 |
| 800 | 2 × 2 |
| 900 | 2 × 2 |
| 1500 (L-Band) | 2 × 2 |
| 1800 | 4 × 4 |
| 2100 | 4 × 4 |
| 2600 | 4 × 4 |

As a consequence, ports and/or antenna arrays should be duplicated, at least in the higher frequency bands. Notably, apart from the above-mentioned gained MIMO capabilities, an increase of the number of ports would also enable very interesting scenarios, like "site sharing", according to which an antenna is shared between at least two different operators. Site sharing would significantly reduce the operational costs.

New frequency bands, like the supplementary downlink (SDL) or the L-Band (1.427-1.52 GHz) are currently being auctioned, and are already licensed in several countries. Therefore, new antenna architectures should preferably support these new bands.

Additionally, in order to facilitate site acquisition and to fulfill local regulations regarding antenna site upgrades, the width of the new antennas should be comparable to legacy products. Further, to maintain the mechanical support structures currently deployed in the antenna sites, also the wind load of the new antennas should be equivalent to a wind load of conventional antennas. These factors lead to a very strict limitation in height and width of new antennas. However, despite these strict site limitations, and also the desired increase of the band widths and/or the addition of new bands, the Radio Frequency (RF) performance of the new antennas should not be worse than the performance of conventional antennas. This is to at least maintain or even improve the current coverage area and network performance.

The above explanations show that it is a big challenge for antenna designers to find new multiband antenna architectures that: allow increasing the number of ports, allow increasing the operating bandwidth and/or the support of new bands, and allow at least maintaining the same RF performance as before, without compromising on the height and width of the new antennas.

Conventional antennas that combine two LB arrays and three HB arrays are referred to as 2L3H antennas. For instance, it is known to arrange two coaxial arrays (HB/LB) and an additional third array (HB) between the two coaxial arrays. The main disadvantage of this conventional antenna is its width, which is not optimal because the distance between the two LB arrays is relatively big so that not too much shadow is created on the central HB array. In addition, with this conventional antenna it is not possible to dispose a shield wall between the two LB arrays.

In another conventional 2L3H antenna, there is in truth only one LB array in the center of the antenna, which array is divided into two arrays by using duplexers at the element level. The resultant duplexed LB arrays, however, do not work in the full bandwidth, but only in sub-bands thereof. As a consequence, 4×4 MIMO is not possible in the LB of this conventional antenna. Additionally, the duplexers are very complex devices (the guard band is quite small), introduce losses, and significantly increase a passive intermodulation (PIM) risk for the antenna.

SUMMARY

In view of the above-mentioned challenges and disadvantages, the present disclosure provides improved multiband antennas. For example, the present disclosure provides a multiband antenna that allows supporting new frequency bands, while maintaining or even improving RF performance, and while maintaining very strict limitations on the antenna height and antenna width. In particular, at least some embodiments of the disclosure provide a multiband antenna for at least two frequency bands, preferably for even more frequency bands. More particularly, a 2L3H antenna with two LB arrays and three HB arrays is provided by at least some embodiments of the present disclosure, where LB-to-LB coupling is minimized. The width of the 2L3H antenna of embodiments thereby does not exceed 430 mm.

The present disclosure provides a multiband antenna in which the interaction between two different LB arrays of radiating elements is minimized so that the arrays of radiating elements can be arranged closer together.

A first aspect of the present disclosure provides an antenna, the antenna including: a plurality of first radiating elements configured to radiate in a first frequency band, the first radiating elements being arranged along a longitudinal direction of the antenna in a first column; and a plurality of second radiating elements configured to radiate in a second frequency band, the second frequency band at least partially overlapping with the first frequency band, the second radiating elements being arranged along the longitudinal direction of the antenna in a second column. The second column is separated from the first column along a lateral direction of the antenna. Feed points of each first radiating element are separated from feed points of each second radiating element along a bore sight direction of the antenna.

Feed points are the points where the transmission between a feeding network of the antenna and the radiating element happens. The feed points are the designated excitation points of the radiating elements, i.e. are the points at which current is excited into the respective radiating elements.

The longitudinal direction of the antenna corresponds to a vertical extension direction of the antenna, when it is arranged in use on an antenna pole. That means, the antenna is in this case arranged on the pole with one longitudinal end pointing downwards, i.e. towards earth, and the other longitudinal end pointing upwards, i.e. towards the sky. In this use case, the bore sight direction is along the direction facing away from the antenna pole.

Due to the feed points being at different heights (positions in the bore sight direction of the antenna), the coupling between the first radiating elements and the second radiating elements is drastically reduced. This reduction allows the two columns to be placed closer together. For instance, if the first and second column of the antenna provide two LB arrays, e.g. of a 2L3H antenna, the antenna width can be kept at 430 mm or less. Furthermore, the RF performance of the antenna is at least the same as for an antenna having a larger width and having two radiating element columns placed further apart from another.

These small dimensions of the antenna facilitate site acquisition and upgrade, and allow the reuse of existing mechanical support structures, because the wind load of the antenna is equivalent to the wind load of conventional antennas. The antenna can also be provided within an increased number of ports, and is suitable for site sharing, thus reducing significantly the operational costs of network operators.

The first and second radiating elements may respectively operate in, for example, a band between 690-960 MHz, and would in this case be considered to be LB radiating elements. Both the first and second radiating elements may be configured to radiate in the same frequency band, or in two different frequency bands that are overlapping each other.

In an implementation form of the first aspect, a shape and/or type of the first radiating element is different from a shape and/or type of the second radiating element.

In this disclosure the formulation "A and/or B" should be understood as a more compact formulation of "at least one of A or B".

For instance, at least one of the first and second radiating elements may be a radiating element with low profile design, for instance, having only a height of 70 mm, which corresponds to 0.16λ at a frequency of, e.g. 690 MHz, where λ is the wavelength for this frequency.

In a further implementation form of the first aspect, the first radiating elements have a cup shape and the second radiating elements have a cross shape.

Such radiating elements are a preferred solution of the disclosure, since it allows arranging the two columns close together, due to a minimized coupling.

In a further implementation form of the first aspect, the feed points of each first radiating element are distanced differently from the center of the first radiating element than the feed points of each second radiating element from a center of the second radiating element.

Thereby, the coupling between the first and second radiating elements in their respective columns is reduced.

In a further implementation form of the first aspect, the first frequency band and the second frequency band are identical.

As mentioned above, preferably the first and second frequency band may cover at least a frequency range of 690-960 MHz.

In a further implementation form of the first aspect, a spacing of the first radiating elements in the first column and/or a spacing of the second radiating elements in the second column is uniform.

Such a uniform spacing leads to the simplest antenna architecture. It also allows, for instance, the reuse of splitters, and/or the reuse of parts and production process step of conventional antennas.

In a further implementation form of the first aspect, a spacing of the first radiating elements in the first column and/or a spacing of the second radiating elements in the second column is non-uniform.

In a further implementation form of the first aspect, a spacing of the first radiating elements in the first column is different from a spacing of the second radiating elements in the second column.

Such different and/or non-uniform spacing in the first and/or second columns may lead to significant advantages. For instance, strong advantages in terms of coupling at array level are obtained. For the uniform case, the separation in the lateral direction between the individual radiating elements in the first and second columns is the same at every array position. Therefore, also the inter-array coupling (phase and amplitude) is the same. With non-uniform and/or different spacing in the two columns, the separation in the lateral direction may be different at different positions, so that also the coupling will be different (i.e. the amplitude will change, and most importantly the phase of the coupling will be rotated), which leads to an improvement in the coupling at array level. The level of improvement may depend on how non-uniform the spacing is. Big differences in the spacing will bring big improvements and small differences will still bring non-significant improvements.

In a further implementation form of the first aspect, a second column is separated from the first column along the lateral direction of the antenna by 0.40-0.70 times the wavelength at the lowest frequency in the first and/or second frequency band.

In the most preferred implementation, the separation is 0.48λ at the lowest frequency. With such a separation, the proposed architecture reaches very low coupling levels.

In a further implementation form of the first aspect, an isolation wall is placed between the first column and the second column.

The isolation wall (or shield wall) is a possibility—especially when the antenna is a 2L3H antenna—because of the first and second columns of radiating elements and their shapes and arrangements. The isolation wall helps to further significantly reduce the coupling between the two columns. Specifically, the shield wall between the two columns helps to achieve an often required level of isolation of 28 dB or less between the two columns, despite of the tight spacing described in particular with respect to the previous implementation form.

In a further implementation form of the first aspect, the antenna further includes a plurality of third radiating elements configured to radiate in a third frequency band higher than the first frequency band and the second frequency band. The third radiating elements are arranged along the longitudinal direction of the antenna in a third column, and the third column is in-line with the first column.

In a further implementation form of the first aspect, the first column and the third column form together a coaxial array of radiating elements, in which at least some of the first and third radiating elements are arranged interleaved with another and at least some of the first radiating elements embed a third radiating element.

With an antenna according to either one of the two above implementation forms, at least one further frequency band can be added to the antenna, without increasing the width and height of the antenna and without sacrificing on its RF performance.

In a further implementation form of the first aspect, the antenna further includes a plurality of fourth radiating elements configured to radiate in a fourth frequency higher than the first frequency band and the second frequency band. The fourth radiating elements are arranged along the longitudinal direction of the antenna in two fourth columns separated from another along the lateral direction of the antenna, and the fourth columns are arranged parallel to the second column.

In a further implementation form of the first aspect, the second column and the two fourth columns form together a side-by-side array of radiating elements, in which the fourth radiating elements are arranged on either side of the second radiating elements.

The antenna according to either one of the two above implementation forms allows adding a further frequency band without increasing the width and height of the antenna and without sacrificing RF performance. In particular, with the third and fourth radiating elements of the previous implementation forms, a 2L3H antenna may be designed with a total width of only 430 mm and with a RF performance that is the same (or even better) than that of a conventional 2L3H antenna.

In a further implementation form of the first aspect, the third frequency band and the fourth frequency band are identical, partially overlapping, or disjoint.

In particular, the fourth frequency band may be higher than the third frequency band, or also vice versa.

In a further implementation form of the first aspect, the antenna is configured for multiband operation in the two lower first and second frequency bands and the two higher third and fourth frequency bands.

In a further implementation form of the first aspect, the antenna further includes a feedboard, where at least each first and second radiating element includes an intermediate element, the intermediate element having feedboard soldering points soldered to the feedboard and feeding network endpoints for exciting currents into the feed points of the respective radiating elements, and where the feedboard soldering points and the feeding network endpoints are connected.

It has to be noted that all devices, elements, units and means described in the present disclosure could be implemented in the software or hardware elements or any kind of combination thereof. All steps which are performed by the various entities described in the present application as well as the functionalities described to be performed by the various entities are intended to mean that the respective entity is adapted to or configured to perform the respective steps and functionalities. Even if, in the following description of specific embodiments, a specific functionality or step to be performed by external entities is not reflected in the description of a specific detailed element of that entity which performs that specific step or functionality, it should be clear for a skilled person that these methods and functionalities can be implemented in respective software or hardware elements, or any kind of combination thereof.

BRIEF DESCRIPTION OF DRAWINGS

The above described aspects and implementation forms of the present disclosure will be explained in the following description of embodiments in relation to the enclosed drawings, in which.

DETAILED DESCRIPTION

Figure 1:
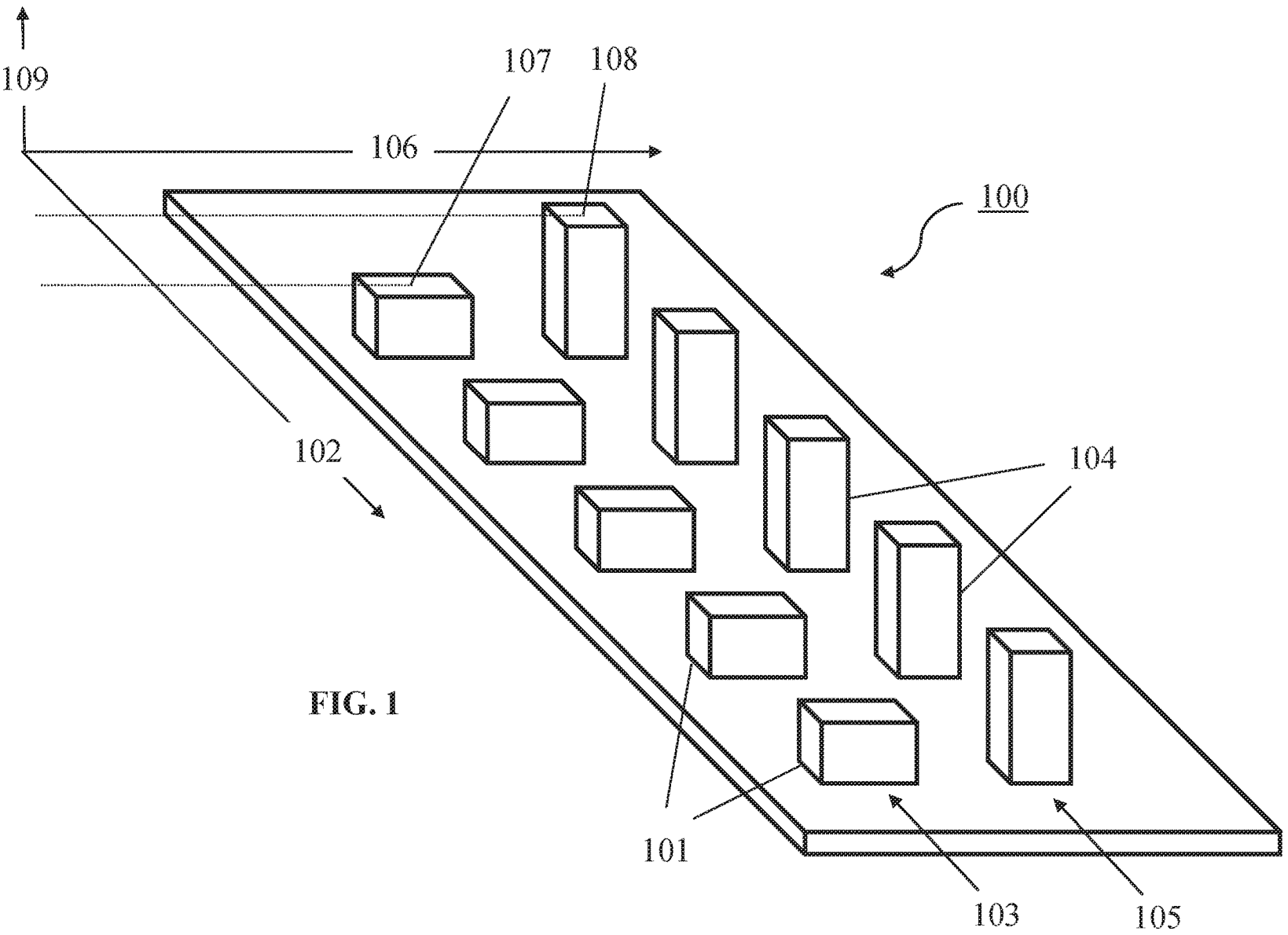
FIG. 1 shows an antenna according to an embodiment of the present disclosure with two different radiating elements.

FIG. 1 illustrates an antenna 100 according to an embodiment of the present disclosure. The antenna 100 of FIG. 1 is configured to operate in at least two frequency bands.

In particular, the antenna 100 includes a plurality of first radiating elements 101, which are configured to radiate in a first frequency band, and a plurality of second radiating elements 104, which are configured to radiate in a second frequency band. The second frequency band is at least partially overlapping with the first frequency band, i.e. the two frequency bands are not disjoint. However, the first frequency band and the second frequency band may be identical, that is completely overlapping. For example, the first and/or second frequency band may be, or at least may cover, the frequency band from 690-960 MHz. Thus, both the first and second radiating elements may each form an LB (Low Band) array.

The first radiating elements 101 are arranged along a longitudinal direction 102 of the antenna 100 in a first column 103. That is, the first radiating elements 101 form the first column, which column 103 represents an array of radiating elements 101. The second radiating elements 104 are also arranged along the longitudinal direction 102 of the antenna 100 in a second column 105. That is, the second radiating elements 104 form the second column 105, which column 105 represents another array of radiating elements 104. The two columns 103 and 105 are separated from another along a lateral direction of the antenna 100. Preferably, the two columns 103 and 105 are parallel in their extension direction along the longitudinal direction 102 of the antenna 100, i.e. the separation along the longitudinal direction 102 between the two columns 103 and 105 is at least substantially the same at every position along the longitudinal direction 102. In addition also the extension of the two columns 103, 105 in the longitudinal direction 102 may be substantially equal. Furthermore, the number of first radiating elements 101 and the number of second radiating elements 104 may be equal.

FIG. 1 shows that the first radiating elements 101 and the second radiating elements 104 are placed at the same positions and have the same spacings with respect to the longitudinal direction 102 of the antenna 100, which is however only exemplary. Details thereof, and other possibilities for the arrangement of the radiating elements 101, 104, will be described below.

The first radiating elements 101 include feed points 107, and the second radiating element 104 includes feed points 108. The feed points 107 and 108 are the points, at which current is excited into the respective radiating elements 101, 104, in order to cause their radiating. In the antenna 100, the feed points 107 of each first radiating element 101 are separated from the feed points 108 of each second radiating element 104 along the bore sight direction 109 of the antenna 100, i.e. along the direction perpendicular to both the lateral direction 106 and the longitudinal direction 102. In other words the feed points 107 are arranged at a different height than the feed points 108.

Figure 2:
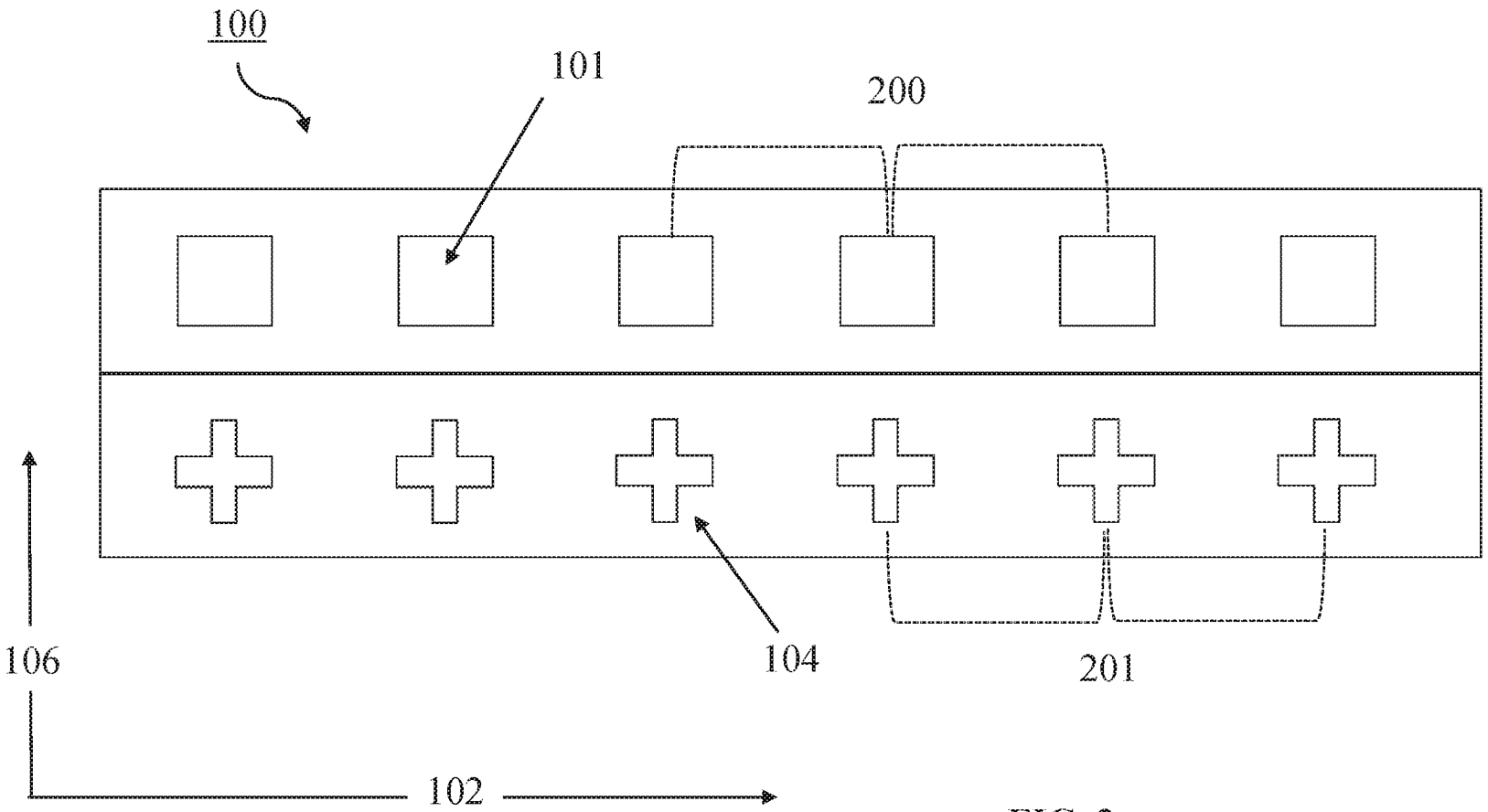
FIG. 2 shows an antenna according to an embodiment of the present disclosure with two different radiating elements and uniform spacing.

FIG. 2 shows an antenna 100 according to an embodiment of the present disclosure, which builds on the antenna 100 of FIG. 1. In FIG. 2, it is highlighted schematically that the first radiating elements 101 are of a different shape and/or type than the second radiating elements 104. In particular, here the first radiating element 101 are shown to have an exemplary square shape, and the second radiating element 104 are shown to have an exemplary cross shape. In this implementation, the arms of the cross shape are in-line with the lateral and longitudinal directions 106 and 102 of the antenna 100. Furthermore, FIG. 2 illustrates a spacing 200 between the first radiating elements 101 in the first column 103, and a spacing 201 between the second radiating element 104 in the second column 105. Specifically, an exemplary antenna 100 is illustrated in FIG. 2, in which both spacings 200 and 201 are uniform and are furthermore the same. Moreover, the radiating elements 101 and 104 are arranged at equal positions along the longitudinal direction 102 of the antenna 100.

Figure 3:
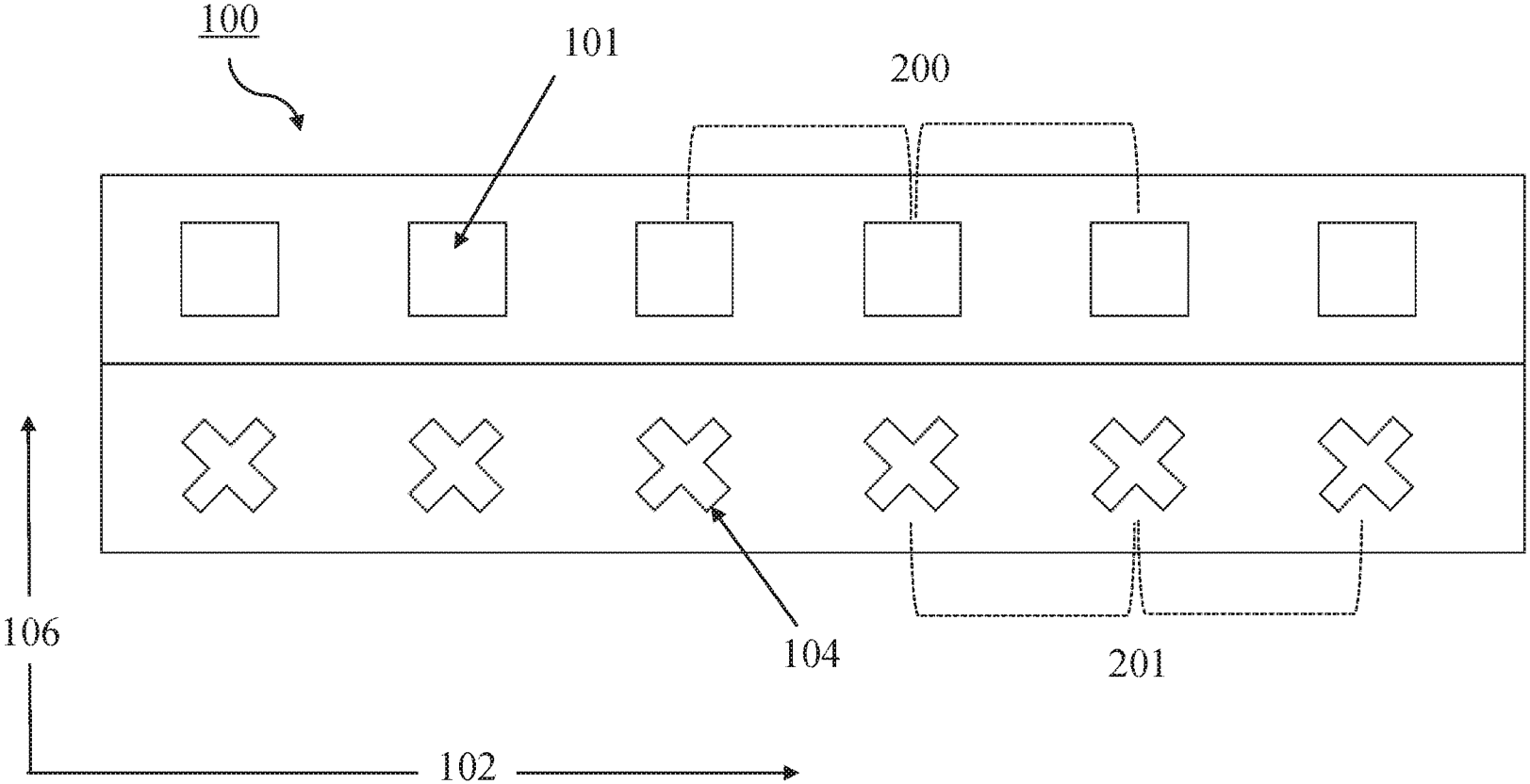
FIG. 3 shows an antenna according to an embodiment of the present disclosure with two different radiating elements and uniform spacing.

FIG. 3 shows an antenna 100 according to an embodiment of the present disclosure, which builds on the antenna 100 of FIG. 1. Again, the different first radiating elements 101 and second radiating elements 104 are shown. Here the second radiating elements 104 are shown to have a cross shape, but are arranged in a different manner than shown in FIG. 2. Namely, in this implementation, the second radiating elements 104 are arranged such that the arms of the cross shapes are not aligned with the longitudinal and lateral directions 102 and 106 of the antenna 100. The first radiating elements 101 are again shown to be square shaped. Further, the spacings 200 and 201 are again uniform and are moreover the same, while the radiating elements 101 and 104 are arranged at equal positions along the longitudinal direction 102.

Figure 4:
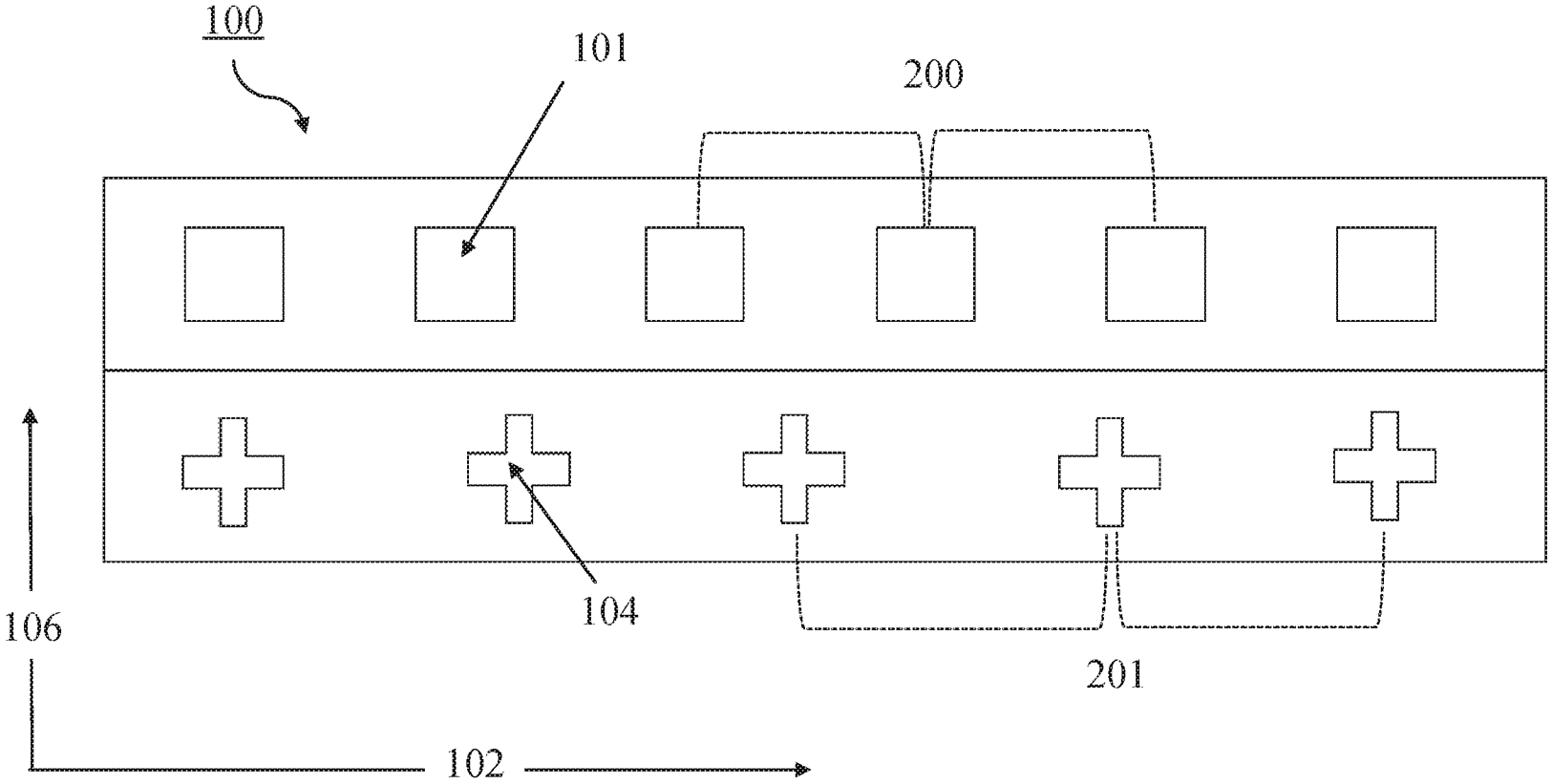
FIG. 4 shows an antenna according to an embodiment of the present disclosure with two different radiating elements and different spacing.

FIG. 4 shows an antenna 100 according to an embodiment of the present disclosure, which builds on the antenna 100 of FIG. 1. FIG. 4 specifically highlights that a spacing 200 of the first radiating elements 101 in the first column 103 is different from a spacing 201 of the second radiating elements 104 in the second column 105. In particular, the spacing 201 of the second radiating elements 104 is exemplarily shown to be larger than the spacing 200 of the first radiating elements 101. Accordingly, the first and second radiating elements 101 and 104 are also not placed at identical positions along the longitudinal direction 102 of the antenna 100. Like in FIG. 2, the first radiating elements 101 have an exemplary square shape, and the second radiating elements 104 have an exemplary cross shape.

Figure 5:
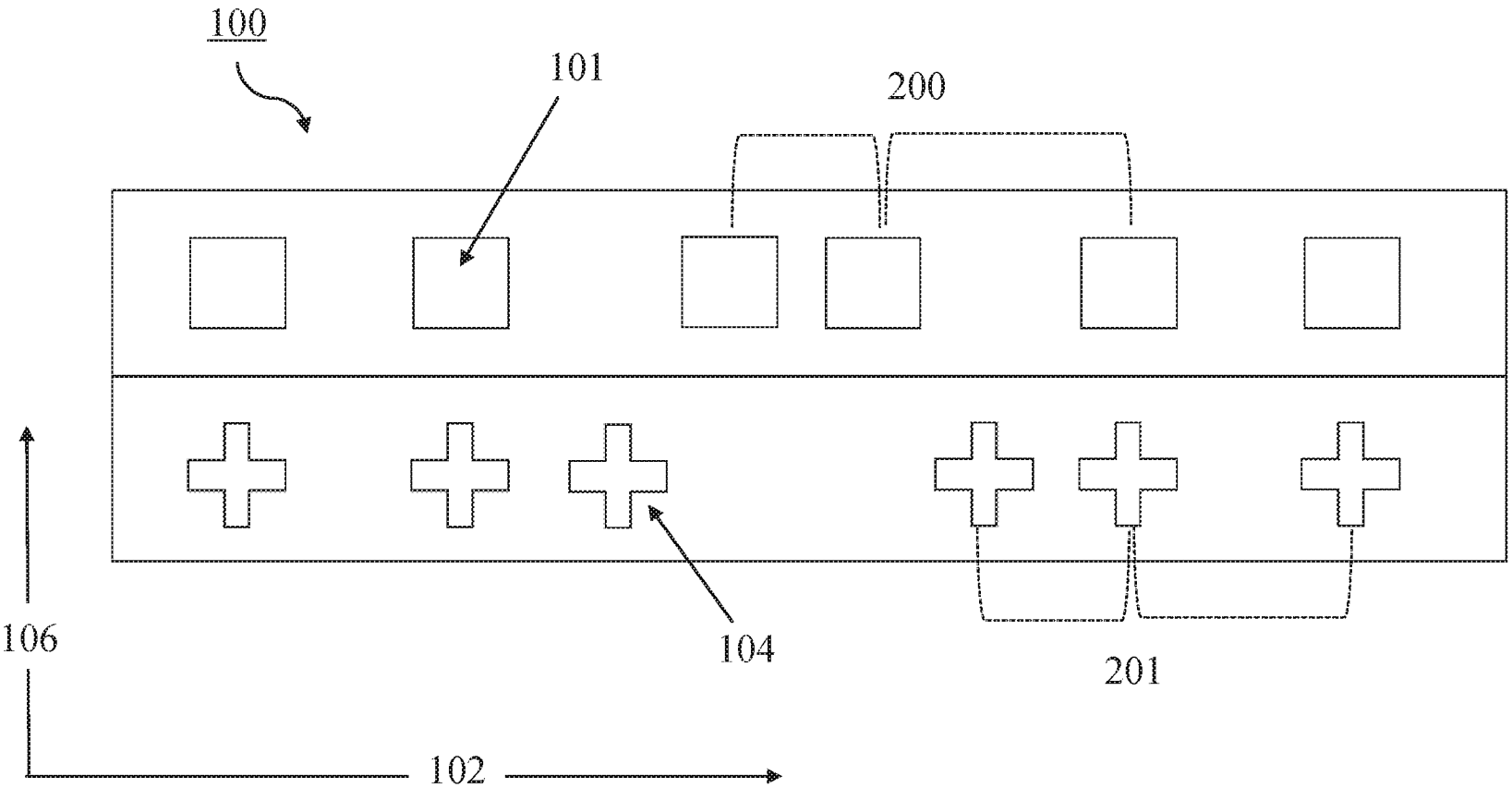
FIG. 5 shows an antenna according to an embodiment of the present disclosure with two different radiating elements and non-uniform spacing.

FIG. 5 shows an antenna 100 according to an embodiment of the present disclosure, which builds on the antenna 100 of FIG. 1. Here in FIG. 5, it is highlighted that both the spacing 200 of the first radiating elements 101 in the first column 103, and the spacing 201 of the second radiating elements 104 in the second column 105 are non-uniform. Accordingly, at least some of the first radiating elements 101 are placed along the longitudinal direction 102 of the antenna 100 at positions, at which no second radiating element 104 is placed. Like in FIG. 2, the first radiating elements 101 have an exemplary square shape, and the second radiating elements 104 have an exemplary cross shape.

Considering the examples of the FIGS. 2 to 5, it is important to mention that the disclosure is not limited to any specific type and/or shape of the first and/or second radiating elements 101 and/or 104, but just to the fact that the first radiating elements 101 should be different from the second radiating elements 104, and that the positions of the feed points 107 and 108 of these radiating elements 101 and 104 are different along the bore sight direction 109 (also designated as height) of the antenna 100.

Furthermore, the spacings 200 and/or 201 along the longitudinal direction 102 of the antenna 100 may not be the same in both columns 103, 105, and may not be uniform either. These features can help to improve (i.e. reduce) the coupling at array level. This is due to different resulting distances between the respective radiating elements 101, 104 in the different columns 103, 105, and of resulting different phases of the coupling between these radiating elements.

Figure 6:
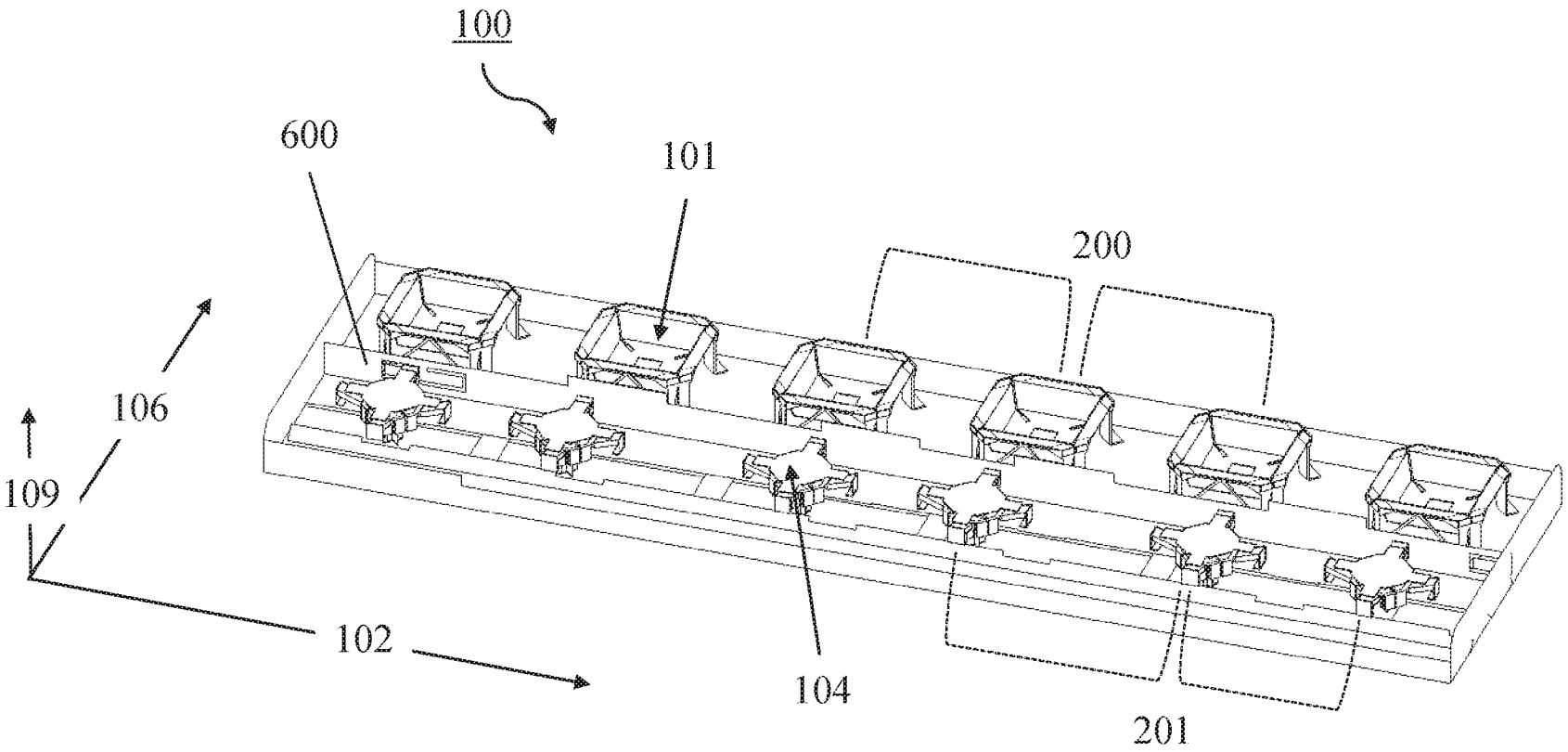
FIG. 6 shows an embodiment according to the present disclosure with two different radiating elements and with different and non-uniform spacing.

FIG. 6 shows an antenna 100 according to an embodiment of the present disclosure, which builds on the antenna 100 of FIG. 1. FIG. 6 is particularly a perspective view of the antenna 100 and of the first radiating elements 101 in the first column 103 and the second radiating elements 104 in the second column 105. Here in FIG. 6, the spacing 200 between the first radiating elements 101 is exemplarily uniform, whereas the spacing 201 between the second radiating elements 104 is exemplarily non-uniform.

In FIG. 6, it can also be well seen that an isolation wall 600 may be placed between the first column 103 and the second column 105, i.e. between the first radiating elements 101 and the second radiating elements 104. This measure reduces even further the coupling between these two arrays (columns) of different radiating elements 101, 104.

Figure 7:
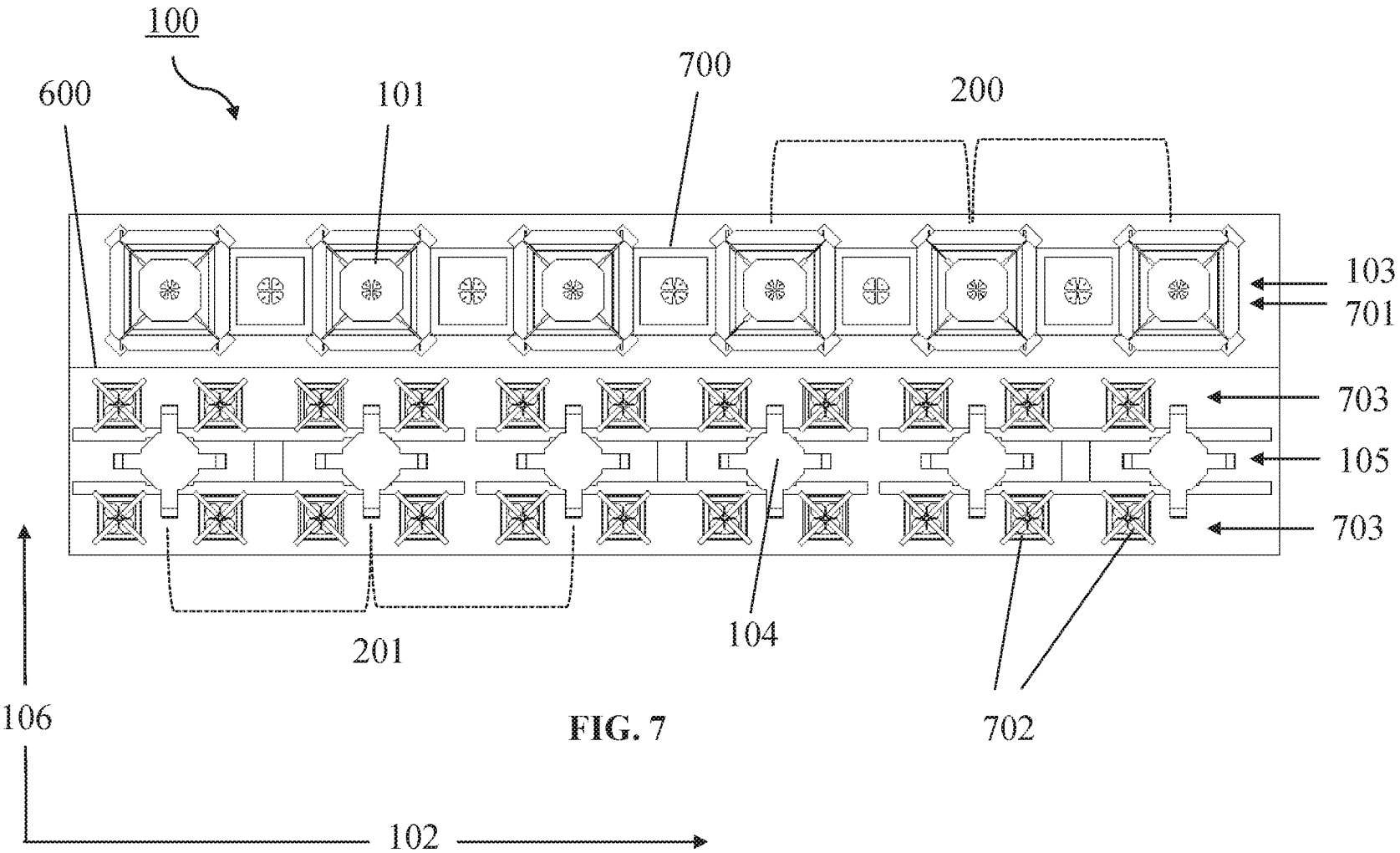
FIG. 7 shows an embodiment according to an embodiment of the present disclosure with four different radiating elements and uniform spacing.

FIG. 7 shows an antenna 100 according to an embodiment of the present disclosure, which builds on the antenna 100 of FIG. 1. In particular, FIG. 7 shows an antenna 100 with a 2L3H architecture in a top view. The antenna 100 includes the first radiating elements 101 arranged in the first column 103, and the second radiating element 104 arranged in the second column 105. Here in FIG. 7, exemplarily, the spacing 200 between the first radiating elements 101 is uniform and is the same as the also uniform spacing 201 between the second radiating elements 104.

Further, the antenna 100 includes a plurality of third radiating elements 700, which are arranged along the longitudinal direction 102 of the antenna 100 in a third column 701. The third column 701 is thereby in-line with the first column 103. In particular, this in-line positioning of the columns 103, 701 is achieved by arranging the third radiating elements 700 interleaved with the first radiating elements 101, where at least some of the first radiating elements 101 embed a third radiating element 701 in between.

Accordingly, the first column 103 and the third column 701 form together a coaxial array of radiating elements 101 and 700.

Further, the antenna 100 includes a plurality of fourth radiating elements 702 arranged along the longitudinal direction 102 of the antenna 100 in two fourth columns 703. These two fourth columns 703 are separated from another along the lateral direction 106 of the antenna 100. Further, the two fourth columns 703 are preferably arranged parallel to the second column 105, and are accordingly parallel to another. Since the fourth radiating elements 702 are arranged on either side of the second radiating elements 104, the second column 105 and the two fourth columns 703 form together a side-by-side array of radiating elements 104 and 702.

That is, the antenna 100 of FIG. 7 combines a coaxial array with a side-by-side array of radiating elements. Preferably, the first radiating element 101 and the second radiating element 104 are both LB radiating elements, i.e. the first frequency band and the second frequency band are lower than the third and the fourth frequency band. Accordingly, the third and fourth radiating elements 700 and 702 may be considered high-band (HB) radiating elements. For instance, they may cover a third frequency band that spans 1427-2200 MHz (third radiating elements 700), and/or a fourth frequency band that spans 1710-2690 MHz (fourth radiating elements 702).

The antenna 100 shown in FIG. 7 can be deployed with a total width of only 430 mm. At the lowest frequency, which is preferably 690 MHz for the LB bands (e.g. 690-960 MHz), the width of 430 mm corresponds to less than 1λ. With the additional shield wall 600 placed between the first 103 and second column 105, and accordingly also between the third column 701 and the fourth column 703, an isolation level between the LB arrays (i.e. the first and second columns) can be as low as 28 dB. Accordingly, it is possible with the antenna 100 of FIG. 7 to provide two arrays with 650 beam width and 28 dB coupling in a width of less than 1λ. This is conventionally not possible or at least very difficult to achieve.

Figure 8:
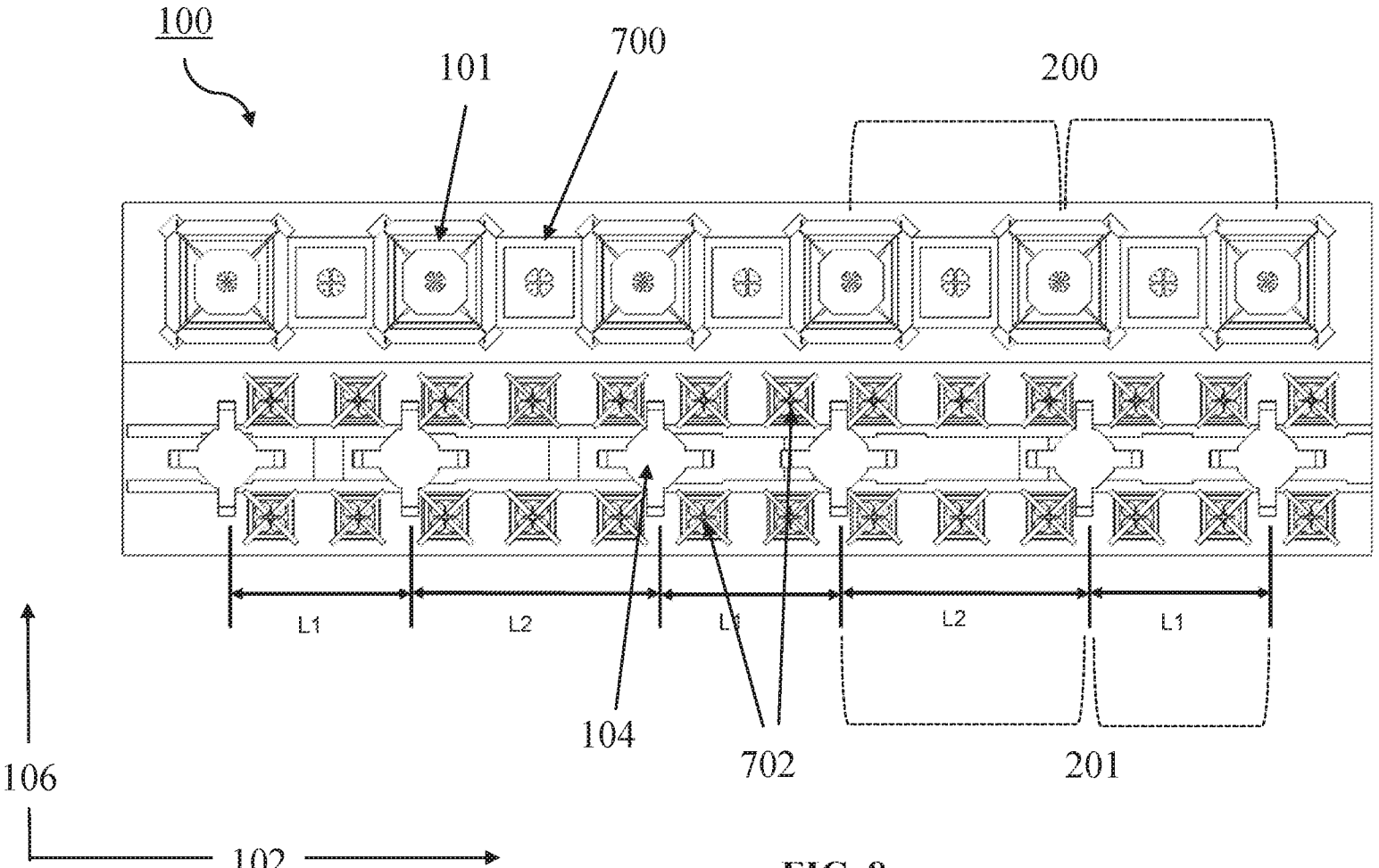
FIG. 8 shows an antenna according to an embodiment of the present disclosure with four different radiating elements and non-uniform spacing.

FIG. 8 shows an antenna 100 according to an embodiment of the present disclosure, which builds on the antenna 100 in the FIGS. 1 and 7. In FIG. 8 the spacing 201 between the second radiating elements 104 in the second column 105 is non-uniform. Also the spacing between the two side-by-side columns 703 of the fourth radiating elements 702 is non-uniform. That is, in the side-by-side array, the spacing is non-uniform in both LB and HB. As can be seen, there are alternatively placed either two or three fourth radiating elements 702 between the second radiating elements 104 along the longitudinal direction 102 of the antenna 100. This helps reducing the average spacing in the fourth column, and therefore reducing the level of the grating lobe in the vertical pattern for larger down tilts of the antenna 100.

For example, the most common case in current base station antennas, with the LB going from 690-960 MHz, and the HB going from 1710-2690 MHz, uniform vertical spacing of 250/125 mm is the most common approach. This spacing is somehow established in the industry, but has a very strong drawback in terms of grating lobe at a down tilt of 12° and at 2690 MHz. With the architecture of the antenna 100 of FIG. 8, the level of the grating lobe can be significantly reduced.

In addition, having the non-uniform spacing also between the second radiating elements 104 can mean a strong advantage in terms of coupling at array level. In the uniform case shown e.g. in FIG. 7, the separation of the first and second radiating elements 101 and 104 along the lateral direction 106 of the antenna 100 is the same at every position, and therefore the coupling (phase and amplitude) is also the same. When all the individual couplings are combined to get the array-to-array coupling, the result is the same as the individual couplings (i.e. it is just an average of several times the same). However, if the spacing along the longitudinal direction 102 of the antenna 100 is different in the first and second columns 103 and 105, the separation along the lateral direction 106 of the antenna 100 between the first and second radiating elements 101 and 104 will be different at every position in the arrays along the lateral direction 102. Since the separation is different, the coupling will also be different (the amplitude will change and most importantly, the phase of the coupling will be rotated). In this case, when all the individual couplings are combined to get the coupling at array level, it is not an average of the same, but of different curves with different phases that will be combined, achieving an improvement in the coupling at array level.

Figure 9:
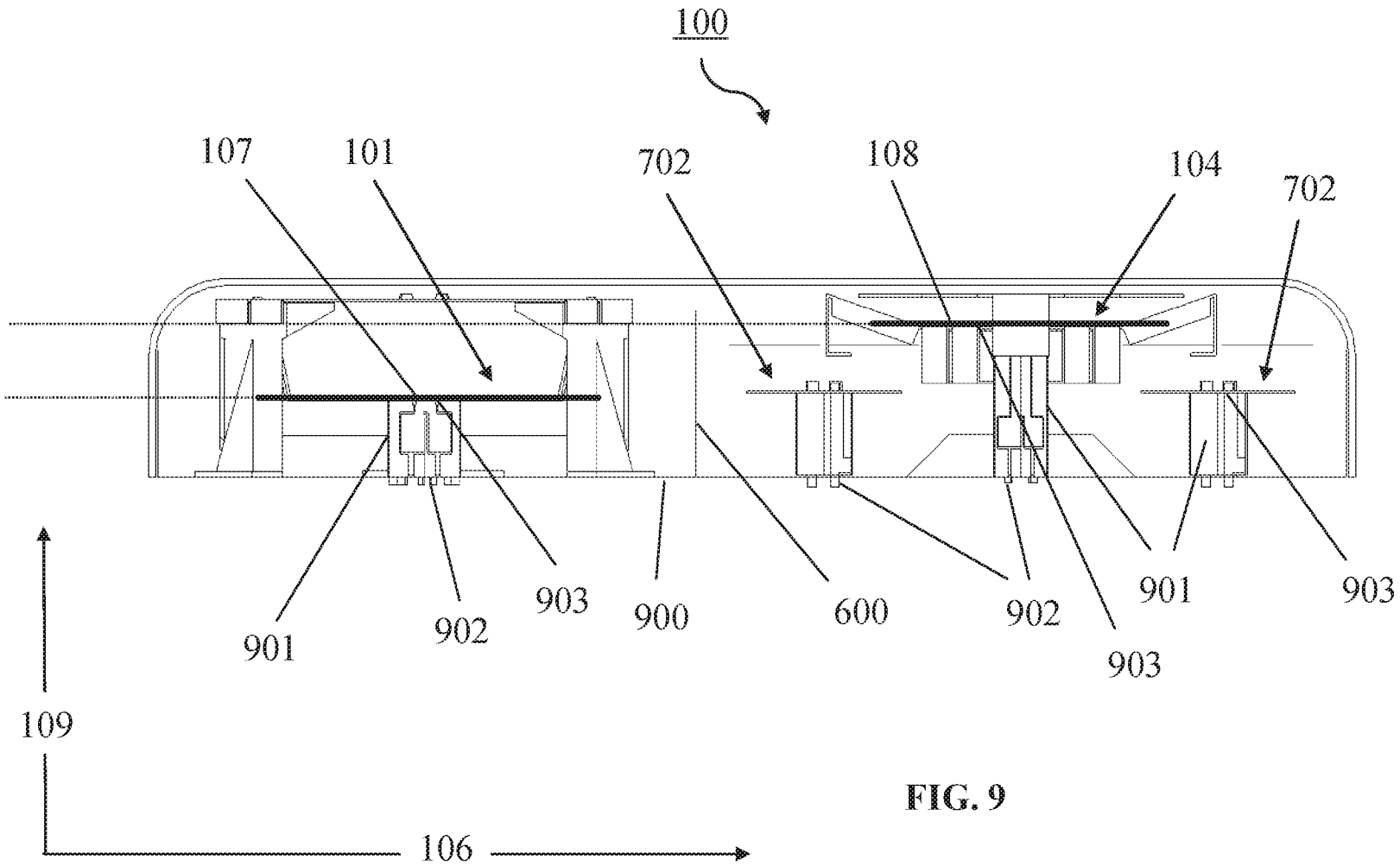
FIG. 9 shows a cross-section through an antenna according to an embodiment of the present disclosure.

FIG. 9 shows an antenna 100 according to an embodiment of the present disclosure, which builds on the antenna 100 shown in the previous figures. FIG. 9 in particular shows a cross-section through the antenna 100, and thereby shows the antenna 100 along the lateral direction 106 and the bore sight direction 109, respectively. On the left side of the antenna 100 in FIG. 9 is placed a first radiating element 101 comprising feed points 107 that are positioned differently along the bore sight direction 109 of the antenna 100 than feed points 108 of a second radiating element 104 placed on the right side of the antenna 100 in FIG. 9. In particular, any feed points 108 of the second radiating element 104 are positioned higher in FIG. 9 than any feed points 107 of the first radiating element 101. Here in FIG. 9, the height of the illustrated antenna 100 corresponds to the bore sight direction 109, as indicated by the coordinate system.

FIG. 9 also shows two fourth radiating elements 702, which are however only shown exemplarily and are optional elements. Optionally, the antenna 100 has also a plurality of the above-described third radiating elements 700.

In addition, FIG. 9 shows that the antenna 100 may also include a feedboard 900, on which the respective radiating elements are provided. At least each first and second radiating element 101, 104 of the antenna 100 includes such an intermediate element 901, like a Printed Circuit Board (PCB). The intermediate element 901 has feedboard soldering points 902 for soldering to the feedboard 900, and has feeding network end points 903 for exciting currents into the feed points 107, 108 of the radiating elements 101, 104, respectively. It can be seen that the feedboard soldering points 902 and the feeding network endpoints 903 are connected e.g. by transmission lines on the intermediate element 901. They may either be directly connected, or may be connected indirectly, for instance, via a power splitter arranged in between. Notably, the intermediate elements 901 also act as a spacer between the feedboard 900 and the radiating part of the radiating elements 101, 104.

Figure 10:
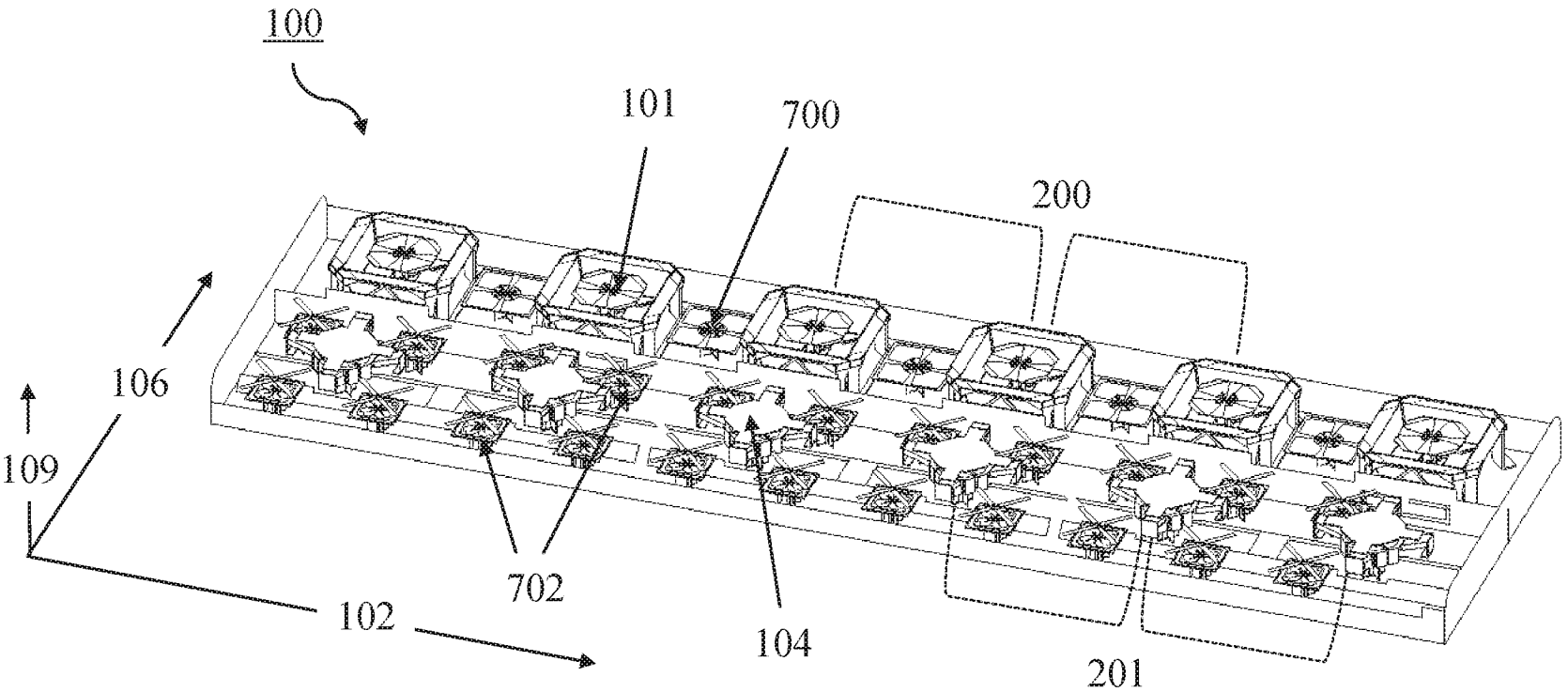
FIG. 10 shows an antenna according to an embodiment of the present disclosure with four different radiating elements and uniform spacing.

FIG. 10 shows in a perspective view an antenna 100 according to an embodiment of the present disclosure, which builds on the antenna 100 shown in FIG. 1. The antenna 100 includes first radiating elements 101 in a first column 103 with a uniform spacing 200, and second radiating elements 104 in a second column 105 with an identical uniform spacing 201. The antenna 100 also includes third radiating elements 700 provided in a column 701 that is in-line with the column of first radiating elements 101, and fourth radiating elements 104 that are provided side-by-side the second radiating elements 104.

In summary, embodiments of the disclosure provide an antenna 100 with a new architecture with significantly reduced coupling between two arrays of radiating elements 101 and 104, namely the first column 103 and the second column 105. Preferably, these columns 101, 104 are LB arrays of a 2L3H antenna. For such a 2L3H antenna, in particular the combination of a coaxial array and a side-by-side array leads to a very compact form factor with a width of not more than 430 mm, while the isolation between the LB arrays is below 28 dB and the RF performance is at least as good as in a conventional antenna. The coupling can particularly be minimized due to the different arrangements of the feed points 107, 108 along the bore sight direction 109, and further improved by different locations and distances of the feed points 107, 108 from the respective centers of the radiating elements 101. In addition, carefully chosen spacings, e.g. non-uniform and different, in the two LB arrays, low profile designs of the individual radiating elements 101, 104, and the provision of a shield wall 600 between the first column 103 and second column 105 reduce the coupling even further.

The present invention has been described in conjunction with various embodiments as examples as well as implementations. However, other variations can be understood and effected by those persons skilled in the art and practicing the claimed invention, from the studies of the drawings, this disclosure and the independent claims. In the claims as well as in the description the word "comprising" does not exclude other elements or steps and the indefinite article "a" or "an" does not exclude a plurality. A single element or other unit may fulfill the functions of several entities or items recited in the claims. The mere fact that certain measures are recited in the mutual different dependent claims does not indicate that a combination of these measures cannot be used in an advantageous implementation.

What is claimed is:

1. An antenna comprising:

a plurality of first radiating elements configured to radiate in a first frequency band, the first radiating elements being arranged along a longitudinal direction of the antenna in a first column; and a plurality of second radiating elements configured to radiate in a second frequency band, the second frequency band at least partially overlapping with the first frequency band, wherein the second radiating elements are arranged along the longitudinal direction of the antenna in a second column, wherein the second column is separated from the first column along a lateral direction of the antenna, and wherein feed points of the first radiating elements are separated from feed points of the second radiating elements along a bore sight direction of the antenna.

2. The antenna according to claim 1, further comprising a shape and/or type of the first radiating elements being different from a shape and/or type of the second radiating elements.

3. The antenna according to claim 1, wherein the first radiating elements have a cup shape and the second radiating elements have a cross shape.

4. The antenna according to claim 1, wherein each of the feed points of the first radiating elements are distanced differently from a respective center of the associated one of the first radiating elements than each of the feed points of the second radiating elements from a respective center of the associated one of the second radiating elements.

5. The antenna according to claim 1, wherein the first frequency band and the second frequency band are identical.

6. The antenna according to claim 1, further comprising:

a spacing of the first radiating elements in the first column and/or a spacing of the second radiating elements in the second column being uniform.

7. The antenna according to claim 1, further comprising a spacing of the first radiating elements in the first column and/or a spacing of the second radiating elements in the second column being non-uniform.

8. The according to claim 6, wherein the spacing of the first radiating elements in the first column is different from the spacing of the second radiating elements in the second column.

9. The antenna according to claim 1, wherein the second column is separated from the first column along the lateral direction by 0.40-0.70 times a wavelength at a lowest frequency in the first frequency band and/or second the frequency band.

10. The antenna according to claim 1 further comprising:

an isolation wall between the first column and the second column.

11. The antenna according to claim 1 further comprising:

a plurality of third radiating elements configured to radiate in a third frequency band higher than the first frequency band and the second frequency band, wherein the third radiating elements are arranged along the longitudinal direction in a third column and the third column is parallel with the first column.

12. The antenna according to claim 11, wherein the first column and the third column together form a coaxial array of radiating elements, in which at least some of the first radiating elements and the third radiating elements are interleaved with another and at least some of the first radiating elements embed one of the third radiating elements.

13. The antenna according to claim 1 further comprising:

a plurality of fourth radiating elements configured to radiate in a fourth frequency band higher than the first frequency band and the second frequency band, wherein the fourth radiating elements are arranged along the longitudinal direction in two fourth columns separated from another along the lateral direction, and the fourth columns are arranged parallel to the second column.

14. The antenna according to claim 13, wherein the second column and the two fourth columns together form a side-by-side array of radiating elements, in which the fourth radiating elements are arranged on either side of the second radiating elements.

15. The antenna according to claim 13, wherein a third frequency band and the fourth frequency band are identical, are partially overlapping, or are disjoint.

16. The antenna according to claim 13, wherein the first frequency band and the second frequency band comprise two lower frequency bands, wherein a third frequency band and the fourth frequency band comprise two higher frequency bands, and the antenna is configured for multiband operation in the two lower frequency bands and the two higher frequency bands.

17. The antenna according to claim 1 further comprising:

a feedboard, wherein each one of the first radiating elements and the second radiating elements comprises an intermediate element, the respective intermediate element having a respective feedboard soldering point soldered to the feedboard and a respective feeding network endpoint for exciting currents into a respective feed point of the feed points, and wherein, for each of the first radiating elements and the second radiating elements, the respective feedboard soldering point and the respective feeding network endpoint are connected.

* * * * *